United States Patent [19]

Everett

[11] 4,381,225

[45] Apr. 26, 1983

[54] PRODUCTION OF LEAD FROM ORES AND CONCENTRATES

[75] Inventor: Peter K. Everett, Chatswood, Australia

[73] Assignee: Dextec Metallurgical Pty. Ltd., North Sydney, Australia

[21] Appl. No.: 220,031

[22] PCT Filed: Apr. 2, 1980

[86] PCT No.: PCT/AU80/00001

§ 371 Date: Dec. 9, 1980

§ 102(e) Date: Dec. 8, 1980

[87] PCT Pub. No.: WO80/02164

PCT Pub. Date: Oct. 16, 1980

[30] Foreign Application Priority Data

Apr. 9, 1979 [AU] Australia ..... PD8329

[51] Int. Cl.[3] ..... C25C 1/18

[52] U.S. Cl. ..... 204/117

[58] Field of Search ..... 204/117

[56] References Cited

U.S. PATENT DOCUMENTS

| | | | |
|---|---|---|---|
| 556,092 | 3/1896 | Frölich | 204/111 |
| 3,673,061 | 6/1972 | Kruesi | 204/107 |
| 3,736,238 | 5/1973 | Kruesi et al. | 204/107 |

*Primary Examiner*—R. L. Andrews

*Attorney, Agent, or Firm*—Pollock, Vande Sande & Priddy

[57] ABSTRACT

Lead is selectively recovered electrolytically from a mixture of metal sulphides in an aqueous chloride electrolyte by controlling the rate of agitation and oxidation conditions so that metal sulphides other than lead remain substantially undissolved.

21 Claims, 1 Drawing Figure

PRODUCTION OF LEAD FROM ORES AND CONCENTRATES

FIELD OF THE INVENTION

Background of the Invention

This invention relates to the selective dissolution and recovery of lead from lead sulphides and soluble ores and concentrates containing lead.

In this respect the invention specifically relates to ores and concentrates in which lead may be either a major or minor component.

Description of the Prior Art

Lead is normally produced from its sulphide ore or concentrate by pyrometallurgical treatment involving smelting. In this treatment sulphur which is contained in the aforementioned ore or concentrate is subjected to oxidation and sulphur dioxide results. Sulphur dioxide has been recognized as a pollutant to the atmosphere. Consequently the operations of lead smelting processes are being increasingly curtailed and made less economic by the severity of recent legislation.

To overcome the disadvantages of the pyrometallurgical process, particularly pollution, processes have been developed to oxidize sulphides under pressure in autoclaves using ammonia solution. The plant is expensive, uses large amounts of ammonia, produces large amounts of ammonia sulphate which must be disposed of, and often requires an associated plant for the production of pure oxygen.

An example of the aforementioned process is the hydrometallurgical process disclosed in Australian Pat. No. 282,292 (Sherritt Gordon Mines 1964). The process, in an ammonium sulphate environment, uses oxygen at a partial pressure of 0.34 to 6.8 atmospheres, and oxidizes lead sulphide to lead sulphate which product requires further treatment to produce lead metal. In this respect it has been found that lead cannot be economically recovered by electrolysis from their sulphides in an electrolyte containing substantial sulphate ions or by a process in which sulphate ions are produced in appreciable amounts.

In addition to the above, other processes have been proposed where the lead sulphide concentrate has been compacted into conductive anodes and oxidized electrically in an electrochemical cell. These processes were not successful due to the high cost of preparing the anodes, and poor current and extraction efficiencies.

Considerable research has also been directed at the leaching of lead sulphide ore or concentrate. Reference is made to U.K. Pat. No. 1,478,571 (Societe Miniere et Metallurgique de Penarroya) in which there is disclosed a method of dissolving non-ferrous metals contained in the sulphide ore or concentrate which comprises lixiviating the ore or concentrate with an aqueous cupric chloride solution, and regenerating cupric ions from the cuprous ions formed during the lixiviation reaction, by means of gaseous oxygen together with hydrochloric acid and/or ferrous chloride. This process produces a mixture of chlorides and the method of recovery of the metals was not disclosed.

Another process (described in U.S. Pat. No. 3,673,061) accomplishes the oxidation of sulphides at the anode of an electrochemical cell. This process recovers a range of base metals indiscriminately by using highly oxidizing conditions. Whilst current densities of 12 amperes/ft$^2$ (130 amps/m$^2$) are mentioned, it exemplifies density in the range of 54–480 amperes/ft$^2$ which are very high. These highly oxidizing conditions result in high cell voltages and rapid corrosion of graphite anodes. It is believed the requirement of highly oxidizing conditions is due to the gradual build-up of a film of elemental sulphur on the surface of the mineral which inhibits the dissolution, thereby requiring more intense oxidation. It is significant to note that in this patent it is indicated that if the average grain size is greater than about 60 mesh U.S. Standard the process is inoperable.

There is also a pending Australian Patent Application No. 41938/78 (Broken Hill Proprietary Ltd.), which indicates that particle contact approximate or with the anode is necessary for effective dissolution. In particular it recites at page 7:

> "A significant parameter in this aspect of the invention is maximisation of the frequency of collisions between individual mineral particles and the feeder electrode, which for dissolution of sulphide minerals, is the anode."

Thus to sum up, the most pertinent prior art discussed above utilizes high anode current densities in combination with acidic chloride electrolytes and increased efficiency is thought to be possible by maximizing collisions between the ore or concentrate particles and the anode.

In contrast to the above, this invention seeks to selectively recover lead from lead bearing materials without the use of high current densities and without the aforementioned requirement of particle contact. Consequent from this is a low cost conversion of lead ores or concentrates to lead at atmosphere pressure without the consumption of expensive reagents or the production of by-products with disposal problems.

SUMMARY OF THE INVENTION

This invention provides a process for selectively recovering lead from a lead bearing ore or concentrate in an electrolytic cell including at least one anode and one cathode, said process including (1) contacting the ore or concentrate with an electrolyte containing chloride ions, and (2) maintaining the electrolyte at a temperature ranging up to the boiling point of the electrolyte and at a pH of up to 7 while applying a low anode current density, whereby sulphur present in the ore or concentrate is substantially converted to elemental form and lead is taken into solution, whilst any other base metal existing in the ore or concentrate remains substantially undissolved.

It has been found that the combination of process parameters recited above substantially reduces the dissolution of other base metals which may be present in the ore or concentrates and surprisingly permits unforeseen economic and highly efficient recovery of lead. That is, it has the advantage of being able to selectively recover lead from mixed Pb-Zn-Cu-Fe sulphides, overcomes the disadvantages of the earlier processes described above and is additionally applicable to lead minerals other than sulphides which are soluble under the process conditions. Further the process is operable with mixed or complex ores.

It is thought that the invention derives its success from the selection of a set of conditions which avoids the formation of an elemental sulphur film, resulting in lower cell voltages, the ability to use graphite anodes, and as mentioned allows very selective recovery of lead from mixtures of lead, zinc, iron and copper sulphides. The conditions used, low anode potential and low solution oxidation potential, are thought to allow an initial dissociation of lead sulphide into ionic lead, and sulphur intermediate compounds which permit diffusion of the sulphur from the surface of the mineral before conversion to the elemental form. The sulphur intermediate compounds can be represented by $H^2S$.

The term "high anode current density" used herein includes potentials over 1000 amp/m$^2$ whilst "low anode current density" indicates a density generally below approximately 200 amp/m$^2$.

PREFERRED ASPECTS OF THE INVENTION

A significant preferred aspect of the invention is the selection of very low anode current densities preferably less than 130 amp/m$^2$ and more preferably in the range 50–100 amp/m$^2$.

Similarly a minimum pH of the electrolyte of 0.5 has been found to be advantageous with the optimum pH range being between 1.5 and 2.5.

Temperature is also a process parameter which is significant and in this respect a range of 30° C. to 110° C. more particularly 50° C. to 80° C. has been found desirable.

To permit immediate lead plating at the cathode at the start of leaching, the electrolyte should initially contain some ionic lead. For example, lead chloride may be included in the electrolyte.

Further, the lead containing mineral may be agitated in the anode compartment of an electrochemical diaphragm cell to permit even attack by the electrolyte.

With regard to the mechanics of the reaction lead sulphide is thought to decompose according to:

$$PbS+2H^+ \rightarrow Pb^{++}+H_2S$$

and the sulphur compound is further oxidised at the anode to elemental sulphur according to:

$$H_2S \rightarrow 2H^+ + S + 2e$$

The overall equation for the cell is:

$$PbS \rightarrow Pb + S$$

In contrast to the aforementioned Australian Patent Application No. 41938/78 it is not necessary for the mineral to be in close proximity to the anode, and increasing selectivity has been achieved with gentle agitation in the bottom of the anode compartment, because of the increased level of oxidation in close proximity to the anodes which may cause dissolution of other minerals which is undesirable. As previously mentioned it is desirable to suspend the mineral to allow attack on all surfaces and to provide a flow pattern to conduct sulphur compounds from the mineral surface to the anode.

The following example illustrates the highly selective nature of the process with the treatment of complex mixed Pb-Zn-Cu-Fe sulphides. Lead in these sulphide mixtures could not be separated economically by conventional froth flotation methods.

EXAMPLE 1

1 kg of each of the sulphide mixtures was slowly agitated in the bottom of the anode compartment of 5 liter electrochemical diaphragm cells in an electrolyte comprising 30% w/v sodium chloride and 4% lead chloride at a pH of approximately 1.5–2.5. Current was passed between the graphite anodes and cathodes at an anode density of 90 amps/m$^2$ and a cathode current density suitable for powder production at the cathode for 5 hrs at 80° C. with the following results. A cathode circulating pump flushed the lead powder product into a settling chamber during the period of the test.

| | Pb % | Zn % | Cu % | Fe % |
|---|---|---|---|---|
| Feed 1 (Spanish) | 8.0 | 24.0 | 10.1 | 18.8 |
| Residue 1 | 0.21 | 26.7 | 10.9 | 20.6 |
| Product 1 | 99+ | .018 | .090 | .003 |
| Feed 2 (Australian) | 11.6 | 18.4 | 10.2 | 15.2 |
| Residue 2 | 0.14 | 18.8 | 11.0 | 17.0 |
| Product 2 | 99+ | .007 | .017 | .0032 |

The current efficiency in both tests was in excess of 90% with a cell voltage of less than 2.0 volts and a power consumption of less than 1 KWH/kg. The results show the extremely selective nature of the extraction, and the high purity of the lead product. The extraction efficiencies are 97% and 99% for lead with only very minor amounts of Zn and Cu going into solution.

The following example illustrates the application of the process to commercial lead concentrates.

EXAMPLE 2

One hundred grams of a lead concentrate assaying 70% Pb, 1.0% Cu, and 1.9% Fe was slowly agitated in a 5 liter diaphragm cell containing an acid electrolyte of 30% NaCl and 4% $PbCl_2$ at 70° C. Current was passed between the graphite anodes and cathodes at 5 amps for 5 hours. The cell voltage was 1.9 V and the anode current density was 90 amps/m$^2$.

The residue analysed 0.9% Pb, 4.9% Fe, and 3.2% Cu giving a Pb extraction efficiency of 99.5%, while leaving the Cu and Fe in the residue.

The above example further illustrates the highly selective nature of the process, the low power costs, and the high extraction efficiencies achieved by operating under these conditions.

Figure 1:
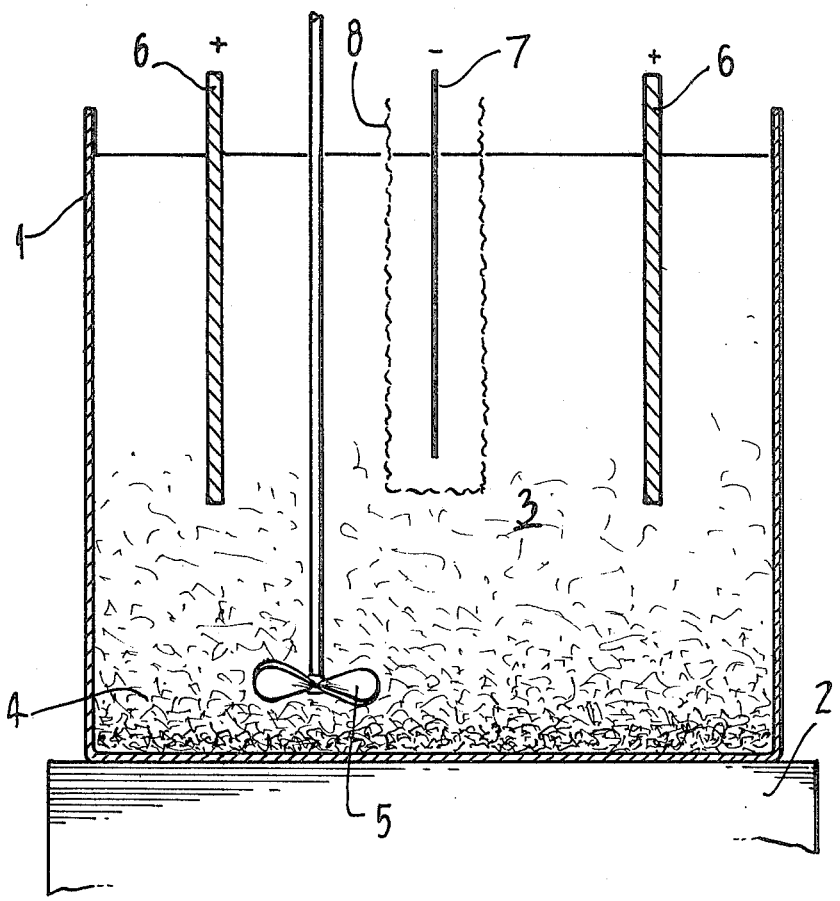
FIG. 1 is a cross-sectional representation of apparatus in which the process the subject of this application can be carried out.

The drawing comprises an electrolytic cell 1 positioned on top of a heater 2 which heater elevates the temperature of the electrolyte 3 and lead ore or concentrate 4 to the desired temperature. A stirrer or agitator 5 is located adjacent the bottom of cell 1 and by rotation causes the movement of ore or concentrate 4 and electrolyte 3. A pair of anodes 6 and a cathode 7 are partially immersed in electrolyte 3 and a potential is applied across the cathode and anode in their un-immersed portions. Above the cathode 7 is a porous cathode bag 8.

Accordingly lead ore or concentrate 4 is dissociated into ionic lead and sulphur intermediate compounds ($H_2S$) which (as previously mentioned) allow diffusion of the sulphur from the surface of the mineral before conversion to the elemental form. The sulphur compounds migrate towards the anode whilst ionic lead migrates to the cathode.

I claim:

1. A process for selectively recovering lead from a lead bearing ore or concentrate also containing base metal sulphides other than lead sulphides in an electrolytic cell including at least one anode and one cathode, said process including (1) contacting the ore or concentrate with an electrolyte containing chloride ions, (2) agitating the electrolyte and ore or concentrate wherein the agitation of said electrolyte and ore or concentrate is controlled to minimize the amount of said ore or concentrate in close proximity to said at least one anode so that the base metal of such sulphides other than lead existing in the ore or concentrate remains substantially undissolved, (3) maintaining the electrolyte at a temperature ranging up to the boiling point of the electrolyte and at a pH of up to 7 while applying a low anode current density and employing low oxidation conditions, whereby sulphur present in the ore or concentrate is substantially converted to elemental form and lead is taken into solution and cathodically selectively recovering said lead.

2. The process according to claim 1 wherein the anode current density is less than 130 amps/$m^2$.

3. The process according to claim 1 wherein the anode current density is in the range of 50–100 amps/$m^2$.

4. The process according to claim 1, 2, or 3 wherein the pH of the electrolyte is in the range of from 0.5 to 7.

5. The process according to claim 1, 2, or 3 wherein the pH of the electrolyte is from 1.5–2.5.

6. The process according to claim 1, 2, or 3 wherein the temperature of the electrolyte is from 30° C. to 110° C.

7. The process according to claim 4 wherein the temperature of the electrolyte is from 30° C. to 110° C.

8. The process according to claim 5 wherein the temperature of the electrolyte is from 30° C. to 110° C.

9. The process according to claim 1, 2, or 3 wherein the temperature of the electrolyte is from 50° C. to 80° C.

10. The process according to claim 4 wherein the temperature of the electrolyte is from 50° C. to 80° C.

11. The process according to claim 5 wherein the temperature of the electrolyte is from 50° C. to 80° C.

12. The process according to claim 1, 2, or 3 wherein the electrolyte initially contains ionic lead.

13. The process according to claim 4 wherein the electrolyte initially contains ionic lead.

14. The process according to claim 5 wherein the electrolyte initially contains ionic lead.

15. The process according to claim 6 wherein the electrolyte initially contains ionic lead.

16. The process according to claim 1, 2, or 3 wherein the electrolyte is an alkali metal chloride or an alkaline earth metal chloride or both.

17. The process according to claim 4 wherein the electrolyte is an alkali metal chloride or an alkaline earth metal chloride or both.

18. The process according to claim 5 wherein the electrolyte is an alkali metal chloride or an alkaline earth metal chloride or both.

19. The process according to claim 6 wherein the electrolyte is an alkali metal chloride or an alkaline earth metal chloride or both.

20. The process according to claim 12 wherein the electrolyte is an alkali metal chloride or an alkaline earth metal chloride or both.

21. The process of claim 1, 2, or 3 wherein said ore or concentrate includes complex mixed metal sulphide.

* * * * *